US009731163B2

(12) United States Patent
Henson

(10) Patent No.: US 9,731,163 B2
(45) Date of Patent: Aug. 15, 2017

(54) EXERCISE MACHINE

(71) Applicants: Cheryl Mary Henson, West Midlands (GB); Timothy George Henson, West Midlands (GB)

(72) Inventor: Timothy George Henson, Birmingham (GB)

(73) Assignee: CHERYL MARY HENSON, Birmingham, West Midlands (GB), part interest ( * ) Notice: Subject to any disclaimer, the term of this patent is extended or adjusted under 35 U.S.C. 154(b) by 58 days.

(21) Appl. No.: 14/351,379

(22) PCT Filed: Oct. 11, 2012

(86) PCT No.: PCT/GB2012/052519
§ 371 (c)(1),
(2) Date: Apr. 11, 2014

(87) PCT Pub. No.: WO2013/054116
PCT Pub. Date: Apr. 18, 2013

(65) Prior Publication Data

US 2014/0256526 A1 Sep. 11, 2014

(30) Foreign Application Priority Data

Oct. 11, 2011 (GB) ..... 1117550.2

(51) Int. Cl.
*A63B 22/18* (2006.01)
*A63B 26/00* (2006.01)
(Continued)

(52) U.S. Cl.
CPC ..... *A63B 22/18* (2013.01); *A63B 26/003* (2013.01); *A63B 21/00058* (2013.01);
(Continued)

(58) Field of Classification Search
CPC ..... A63B 22/18; A63B 26/003; A63B 22/16; A63B 2208/0204; A63B 22/14;
(Continued)

(56) References Cited

U.S. PATENT DOCUMENTS 2,707,465 A * 5/1955 Nemeth ..... A61H 1/0292 482/146
2,827,894 A * 3/1958 Meyers ..... A61H 1/0266 601/31

(Continued)

FOREIGN PATENT DOCUMENTS

DE 20 2010 004545 U1 7/2010
EP 1 880 702 A2 1/2008

(Continued)

OTHER PUBLICATIONS

Search Report from GB 1218227.5, date of search Nov. 19, 2012.

(Continued)

*Primary Examiner* — Andrew S Lo
(74) *Attorney, Agent, or Firm* — Hamilton, Brook, Smith & Reynolds, P.C.

(57) ABSTRACT

The present invention provides an exercise machine comprising a base, a platform having an upper side adapted in use to support a user and an underside, a support column supporting the platform in a position spaced apart from the base wherein the platform is secured to the support column such that the platform can rotate about two perpendicular axes, and three or more means independently operable to move all or a part of the platform, wherein one or more of the means independently operable to move all or part of the platform is capable in use of adopting at least two positions relative to the platform.

23 Claims, 16 Drawing Sheets

(51) Int. Cl.
*A63B 21/00* (2006.01)
*A63B 71/06* (2006.01)
*A63B 22/20* (2006.01)
*A63B 24/00* (2006.01)

(52) U.S. Cl.
CPC ..... *A63B 22/20* (2013.01); *A63B 24/0087* (2013.01); *A63B 71/0619* (2013.01); *A63B 2208/0204* (2013.01)

(58) Field of Classification Search
CPC ..... A63B 22/0605; A63B 22/0087; A63B 22/0089; A63B 22/20; A63B 22/201; A63B 22/203; A63B 22/205; A63B 22/208; A63B 26/00; A63B 2026/00; A63B 2026/003; A63B 2026/006; A63B 22/00; A63B 22/0046; A63B 22/0048; A63B 22/0056; A63B 22/0058; A63B 22/0061; A63B 22/0064; A63B 22/0069; A63B 23/04; A63B 23/0405; A63B 23/0417; A63B 23/0423; A63B 23/0429; A63B 23/0458; A63B 23/0464; A63B 23/0482; A63B 23/0488; A63B 23/0494; A63B 23/08; A63B 23/085; A63B 23/10; A63B 2023/00; A63B 2023/003; A63B 2023/006; A63B 2023/035; A63B 2023/04; A63B 2023/0405
USPC ..... 482/146, 51; 601/49
See application file for complete search history.

(56) References Cited

U.S. PATENT DOCUMENTS 4,515,363 A * 5/1985 Schleffendorf ..... A63B 21/155 482/100
4,946,160 A * 8/1990 Bertoletti ..... A63B 22/18 482/146
5,113,851 A * 5/1992 Gamba ..... A47C 9/002 297/330
5,429,562 A * 7/1995 Milner ..... A63B 22/18 482/142
5,454,774 A * 10/1995 Davis ..... A63B 22/18 434/258
5,941,807 A * 8/1999 Cassidy ..... A63B 21/1419 482/130
6,225,977 B1 5/2001 Li
6,428,451 B1 * 8/2002 Hall ..... A63B 22/18 482/146
6,558,304 B1 * 5/2003 Bardon ..... A63B 21/00178 482/147
7,278,976 B1 * 10/2007 Chen ..... A61H 1/005 601/30
7,278,977 B1 * 10/2007 Chen ..... A61H 1/003 601/30
2003/0139268 A1 * 7/2003 Chen ..... A63B 22/18 482/146
2003/0199374 A1 * 10/2003 Perry ..... A61H 1/005 482/146
2004/0138028 A1 * 7/2004 Hsieh ..... A63B 22/18 482/51
2004/0144288 A1 7/2004 Chiang
2007/0027009 A1 * 2/2007 Arnold ..... A63B 21/005 482/146
2007/0184953 A1 * 8/2007 Luberski ..... A63B 22/18 482/146
2007/0207900 A1 * 9/2007 Huang ..... A63B 26/003 482/51
2007/0213179 A1 * 9/2007 Trandafir ..... A61H 1/005 482/51
2007/0239088 A1 * 10/2007 Wu ..... A61H 1/005 601/49
2008/0146424 A1 * 6/2008 Ho ..... A63B 21/0058 482/147
2008/0280740 A1 * 11/2008 Knecht ..... A61B 3/113 482/146
2008/0300520 A1 * 12/2008 Shin ..... A61H 1/003 601/49
2009/0069157 A1 * 3/2009 Wilhelm ..... A61H 1/003 482/51
2009/0163337 A1 * 6/2009 Petrakov ..... A61H 1/005 482/147
2010/0069201 A1 * 3/2010 Aigner ..... A63B 22/14 482/4
2010/0087302 A1 * 4/2010 Fukunaga ..... A61H 1/005 482/146
2010/0222187 A1 * 9/2010 Tudico ..... A61H 1/001 482/110
2010/0234187 A1 * 9/2010 Lanny ..... A01K 15/027 482/52
2011/0039669 A1 * 2/2011 Stewart ..... A63B 21/015 482/146
2011/0196270 A1 * 8/2011 Fuster ..... A61H 1/005 601/23
2013/0005547 A1 * 1/2013 Wang ..... A63B 22/18 482/142
2014/0045664 A1 * 2/2014 Hockridge ..... A63B 26/00 482/142
2015/0182791 A1 * 7/2015 Tsuzuki ..... A63B 21/023 482/139

FOREIGN PATENT DOCUMENTS

EP 2160168 3/2010
FR 2641183 A1 7/1990
JP 2009160171 7/2009
TW 200821015 5/2008
WO WO 02/076556 A1 10/2002
WO WO 2009/062700 A1 5/2009

OTHER PUBLICATIONS

Search Report from GB 1117550.2, date of search Dec. 8, 2011.
International Search Report for Int'l Application No. PCT/GB2012/052519, Date Mailed: Feb. 14, 2013.

* cited by examiner

EXERCISE MACHINE

This application is the U.S. National Stage of International Application No. PCT/GB2012/052519, filed on Oct. 11, 2012, which designates the U.S., published in English, and claims priority under 35 U.S.C. §119 or 365(c) to Great Britain Application No. 1117550.2, filed Oct. 11, 2011.

The present invention relates to an exercise machine, in particular an exercise machine for use in the general fitness, injury and rehabilitation fields.

There is in existence an exercise machine marketed as POWER PLATE which comprises a vibrating platform on which poses are held and the vibrations cause muscle contraction as a reflex giving rise to a body work out.

Also available is an exercise machine marketed as BALANCE MASTER which comprises an angled platform whose inclination and orientation can be adjusted and the user can carry out stretching exercises whilst mounted on the platform.

There are also known wobble/balance boards comprising a platform mounted on a fulcrum with the aim of the user being to maintain a balanced position.

The present invention provides an exercise machine comprising a base, a platform having an upper side adapted in use to support a user and an underside and three or more means independently operable to move all or a part of the platform, wherein one or more of the means independently operable to move all or part of the platform is capable in use of adopting at least two positions relative to the platform.

The present invention provides an exercise machine comprising a base, a platform having an upper side adapted in use to support a user and an underside, a support column supporting the platform in a position spaced apart from the base wherein the platform is secured to the support column such that the platform can rotate about two perpendicular axes, and three or more means independently operable to move all or a part of the platform, wherein one or more of the means independently operable to move all or part of the platform is capable in use of adopting at least two positions relative to the platform.

In one embodiment each of the means independently operable to move all or a part of the platform is capable in use of adopting at least two positions relative to the platform.

In one embodiment one or more of the means independently operable to move all or a part of the platform is capable in use of adopting at least three positions relative to the platform. For example, each of the means independently operable to move all or a part of the platform is capable in use of adopting three positions relative to the platform.

The provision of three or more means to move all or a part of the platform, where one or more is capable of adopting at least two positions relative to the platform when in use, means that all or part of the platform adopts or is capable of adopting a variety of different orientations, for example the platform may be free moving, may tilt freely about an axis and/or be angled.

In one embodiment the means independently operable to move all or a part of the platform are all positioned beneath the platform.

The three or more means independently operable to move all or a part of the platform may be mounted on a part of the base.

In one embodiment there are four means independently operable to move all or a part of the platform and these are all mounted on a part of the base. The four means are preferably spaced uniformly in relation to the shape and size of the platform. The four means are preferably positioned on a part of the base such that they act on the underside of the platform.

The platform may be circular and the means to move all or a part of the platform may be positioned on a part of the base such that in use they act on four equi-spaced points on the underside of the circular platform. As an example the points may be positioned somewhere along radii of the platform, the radii being spaced at 90° intervals measured from the centre point of the platform.

In one embodiment the support column is secured at one end to a part of the base. In one embodiment the support column maybe secured at the other end to a part of the platform, for example the underside of the platform.

In one embodiment the support column may be of variable length, for example it may have two or more telescopic parts. In one embodiment the support column is a telescopically extendible sliding spline shaft and elongate housing arrangement. The support column may be of any suitable cross-section, for example circular, square, triangular.

In one embodiment the support column is secured to the underside of the platform by means of a suitable joint such as a universal joint, a ball and socket joint or the like.

In one embodiment the exercise machine may be provided with a motor plate having an upper side and an underside, positioned beneath and spaced apart from the platform so that its upper side faces the underside of the platform. The motor plate may be mounted to the base such that it is rotatable about its centre point.

The motor plate may be the same shape as the platform and may be the same size or larger than the platform. The motor plate and platform each have a centre point and are preferably positioned with their centre points on the same longitudinal axis running through and perpendicular to the motor plate.

In one embodiment the motor plate and platform are not independently rotatable. The motor plate and platform preferably rotate together. The motor plate and platform are preferably secured together such that they are not independently rotatable.

In one embodiment the support column is secured at one end to the motor plate. In one embodiment the support column is secured at the other end to a part the platform, for example the underside of the platform. In one embodiment the support column may be of variable length, for example it may have two or more telescopic parts. The support column may be of any suitable cross-section, for example circular, square, triangular.

In one embodiment the support column is secured to the underside of the platform by means of a suitable joint such as a universal joint, a ball and socket joint or the like.

The motor plate may be provided with a support column extending from the centre point of its upper side. In one embodiment the support column is a telescopically extendible sliding spline shaft and elongate housing arrangement. The platform may be provided with a universal joint, or part thereof, secured to the centre point of its underside. In one embodiment the universal joint is secured to the support column, for example to a part of the telescopically extendible sliding spline shaft, and the platform.

The three or more means independently operable to move all or a part of the platform may be mounted on the motor plate, for example on its upper side.

In one embodiment there are four means independently operable to move all or a part of the platform and these are all mounted on the motor plate. The four means are preferably spaced uniformly in relation to the shape and size of the platform. The four means are preferably positioned on the motor plate such that they act on the underside of the platform.

The platform may be circular and the means to move all or a part of the platform may be positioned on the motor plate such that in use they act on four equi-spaced points on the underside of the circular platform. As an example the points may be positioned somewhere along radii of the platform, the radii being spaced at 90° intervals measured from the centre point of the platform.

A guard support ring may be provided positioned between the base and the platform. The guard support ring may have an outer diameter that corresponds with that of the base, or is greater or smaller than that of the base.

A guard support ring may be provided positioned between the motor plate and the platform. The guard support ring may have an outer diameter that corresponds with that of the motor plate, or is greater or smaller than that of the motor plate.

The motor plate may be provided with gear teeth extending around all or part of its perimeter edge. The exercise machine may be provided with a motor that can act on the gear teeth of the motor plate to cause rotation of the motor plate. The motor may drive a shaft provided with a gear wheel and the gear wheel may mesh with the gear teeth of the motor plate and cause rotation of the motor plate. The motor may be mounted such that it can be brought into contact with the gear teeth of the support plate as required, for example by means of an actuator.

The provision of the gear teeth and a motor that can be brought into contact with those teeth means that the motor can be used to cause rotation of the motor plate and the platform secured thereto but also the motor plate can rotate freely in the absence of the motor meaning it can be caused to rotate by action of the user.

As an alternative to the use of an actuator, the motor may be arranged to be in continuous contact with the gear teeth but to allow free rotation of the motor plate or to drive rotation of the motor plate depending on the wishes of the user. A controller may be used to allow the user to signal to the motor whether free or driven rotation is required.

The base of the exercise machine may comprise a hollow three dimensional structure having any suitable cross sectional shape when viewed from above, for example a square, rectangular, triangular or "D" shape. The base may be of uniform depth.

The base may comprise a frame and a removable cover or a cover having at least one removable portion to allow access to the inside of the base. The cover may have an upper surface and side walls extending downwards therefrom.

The motor plate and the guard support ring may be positioned within the base. The platform may be positioned above the upper surface of the cover of the base.

A casing may be provided extending downwardly from the perimeter of the platform. The casing may be "barrel" shaped in relation to its side walls. The distance from the centre point of the universal joint to any point of the side wall of the casing is preferably the same.

The machine may be provided with a ring of upwardly extending resilient fingers extending upwards from the guard support ring. The fingers may be biased to contact the casing. The resilient fingers may be made from any suitable resilient material such as steel or a plastics material, for example polypropylene.

A protective guard may be provided extending from the guard support ring to the platform. The guard may be frustoconical. The guard may be flexible. The guard may be a suitable shaped and sized gator. The guard may encase both the casing and the resilient fingers, all of which act individually and together as guards against access into the base The cover of the base may be provided with a cut out in its upper surface of approximately the same size and shape as the guard support ring. The motor plate and guard support ring may be positioned in the base such that the cut out is positioned just above the guard support ring. The platform may be positioned above the cut out.

The motor plate may be secured to a portion of the base. The motor adapted in use to cause rotation of the motor plate may also be secured to the base. The base may be provided with a base plate, the motor and/or the motor plate may be secured to the base plate. The motor plate may be secured to the base plate such that it is rotationally movable about its centre point. The motor may be secured to the base plate such that it can be moved into and out of contact with the gear teeth of the motor plate, for example by means of an actuator.

The base may be provided with wheel or castors to assist in its movement.

An upright column may be provided extending upwardly from the base. The upright column may be provided with one or more sets of handles.

The upright column may be provided with a control panel and/or a display screen.

In one embodiment the three or more means independently operable to move all or part of the platform are each adapted in use to apply pressure to a part of the underside of the platform. Each means to move all or a part of the platform may have a first position in which it is not in active engagement with the underside of the platform. Each means to move all or a part of the platform may have a second position in which it can be in contact with the underside of the platform and may push a part of the platform up to a first raised position. Each means to move all or a part of the platform may have a third position in which it is in contact with the underside of the platform and pushes a part of the platform up to a second raised position.

The movement of each of the means independently operable to move all or a part of the platform may be progressive between one or more of the first, second and third positions. The progressive movement will give rise to a progressive change in orientation, of the platform. This can allow the degree of movement of the platform to be varied so that for example the degree of movement can be increased with experience and development of the user.

The means may be any means suitable to apply pressure to a part of the underside of the platform, for example, lead screws, hydraulic cylinders, pneumatic cylinders or cams. The means may be operable by any suitable means, for example one or more motors. Each means to move all or part of the platform may be provided with one motor and, as required, any gearbox and/or pump arrangement. Alternatively two or more means to move all or part of the platform may be provided with one shared motor and appropriate clutches and drive trains, gearboxes and/or pumps as required to allow the one motor to drive two or more means to move all or part of the platform.

In one embodiment each means independently operable to move all or a part of the platform is a cam.

Each cam is preferably mounted on a shaft driven by a motor. An appropriate gear arrangement may be provided between the motor and shaft for the cam. The gear arrangement may be a simple gearbox or alternatively there may be provided one or more additional gears outside the gear box.

Each cam may be provided with one motor. Alternatively two, three, four or more cams may be provided with one shared motor and appropriate clutches and drive trains to allow the one motor to drive two, three, four or more cams.

In one embodiment each motor may be mounted on a part of the base.

In one embodiment each motor may be mounted on the motor plate.

Each cam is preferably shaped and/or sized and/or mounted such that the cam surface has at least one, preferably two, positions of active engagement with the platform. In the first position of active engagement the cam can at least contact a part of the underside of the platform to give a first position and may apply pressure to raise the platform up into a first raised position. In the second position of engagement the cam contacts a part of the underside of the platform and applies pressure to raise this up into a second raised position. The second raised position is higher than the first raised position relative to the motor plate.

The shape of the cam may also give rise to a position in which the cam does not actively engage the platform.

The cams preferably move progressively between the two positions of active engagement and/or between the position in which the cam does not actively engage the platform and one or more of the two positions of active engagement. Progressive movement means smooth movement of the platform between positions and also means that the or each cam can adopt a vast number of positions as could all or a part of the platform itself.

Each cam may be, for example egg shaped.

The cams may be operated independently to give a variety of orientations to the platform. A number of examples follow in which four cams are provided:

As a first orientation all of the cams may be rotated into the first active position of engagement and therefore at least actively contact the underside of the platform. In this first position the platform is locked in a position that is parallel to the motor plate and generally also to the surface on which the machine rests, and is preferably horizontal. The platform may also be in a first raised position if, in the first active position, the cams apply pressure to the underside of the platform to raise it into a first raised position.

As a second orientation all of the cams may be rotated into the second active position of engagement and therefore actively contact and apply pressure to the underside of the platform and the platform is in a second raised position, above that of the first orientation described above. In this position the platform is locked in a position that is parallel to the motor plate and generally also to the surface on which the machine rests, and is preferably horizontal. The cams may move progressively from the first active position into the second active position therefore smoothly moving the platform from the first (raised) position into the second raised position.

As a third orientation all of the cams may be rotated into the position where they do not actively engage the platform and therefore they do not actively contact or apply pressure to the underside of the platform. In this position the platform is free to tilt in any direction about its centre point through the universal joint securing it to the support column. In this position the user can drive the platform to adopt any position desired. During use the platform may contact one or more of the cams but this is not active contact on the part of the cams but a passive contact.

As a fourth orientation two of the cams may be rotated into the first or second active position of engagement and therefore at least contact, and may also apply pressure to and raise, a part of the underside of the platform. The remaining cams are rotated into the position where they do not actively engage the platform and therefore they do not actively contact or apply pressure to the underside of the platform. In this position the platform is either fixed at an angle or free to tilt about an axis extending between the actively engaged cams, depending on which cams are engaged. In this position the user may be free to control the tilt of the platform or can work on an angled platform. Again, during use the platform may contact one or more of the cams positioned to not actively engage the platform but this is not active contact on the part of the cam but a passive contact.

As a fifth orientation two oppositely positioned cams may be rotated into the first active position of engagement and therefore at least actively contact a part of the underside of the platform and one of the remaining two cams may be rotated in to the second active position and therefore apply pressure to and raise a part of the platform into the second raised position. In this position the platform is locked in an angled position.

As an example of the impact of progressive movement of the cams between positions, in the fifth orientation if the cams are all rotated at the same rate, or even at differing rates the orientation of the angled part of the platform with change with rotation of the cams and a sort of "wave motion" will occur.

As a sixth orientation three of the four cams may be rotated into the first or second active position of engagement and therefore at least actively contact a part of the underside of the platform and the remaining cam may be rotated in to position where it does not actively engage the platform, or one of the position where it does not actively engage the platform or the first active position, respectively. In this position the platform adopts a raised position that is capable of tilt in one area.

The underside of the platform may be provided with a number of cam followers appropriately positioned to engage with the cams provided. The cam followers may be in the form of wheels mounted on the underside of the platform such that they freely rotate. The cam followers are preferably provided with rubber tyres that act as shock absorbers on contact with the cams and also assist in taking up angular errors that occur during movement of the cams and platform.

The positions described above can be readily achieved with any means suitable to push up all or a part of the platform.

The present invention provides an exercise machine comprising a base, a platform having an upper side adapted in use to support a user and an underside and three or more cams independently operable to move all or a part of the platform, wherein one or more of the cams is capable in use of adopting at least two positions relative to the platform.

In one embodiment there may also be provided a support column supporting the platform in a position spaced apart from the base wherein the platform is secured to the support column such that the platform can rotate about two perpendicular axes.

All of the above disclosed features can apply to this aspect of the invention.

A number of embodiments of the invention will now be described with reference to the drawings. The description and drawings are not intended to be limiting on the scope of protection and are purely example embodiments. In the figures.

Figure 1:
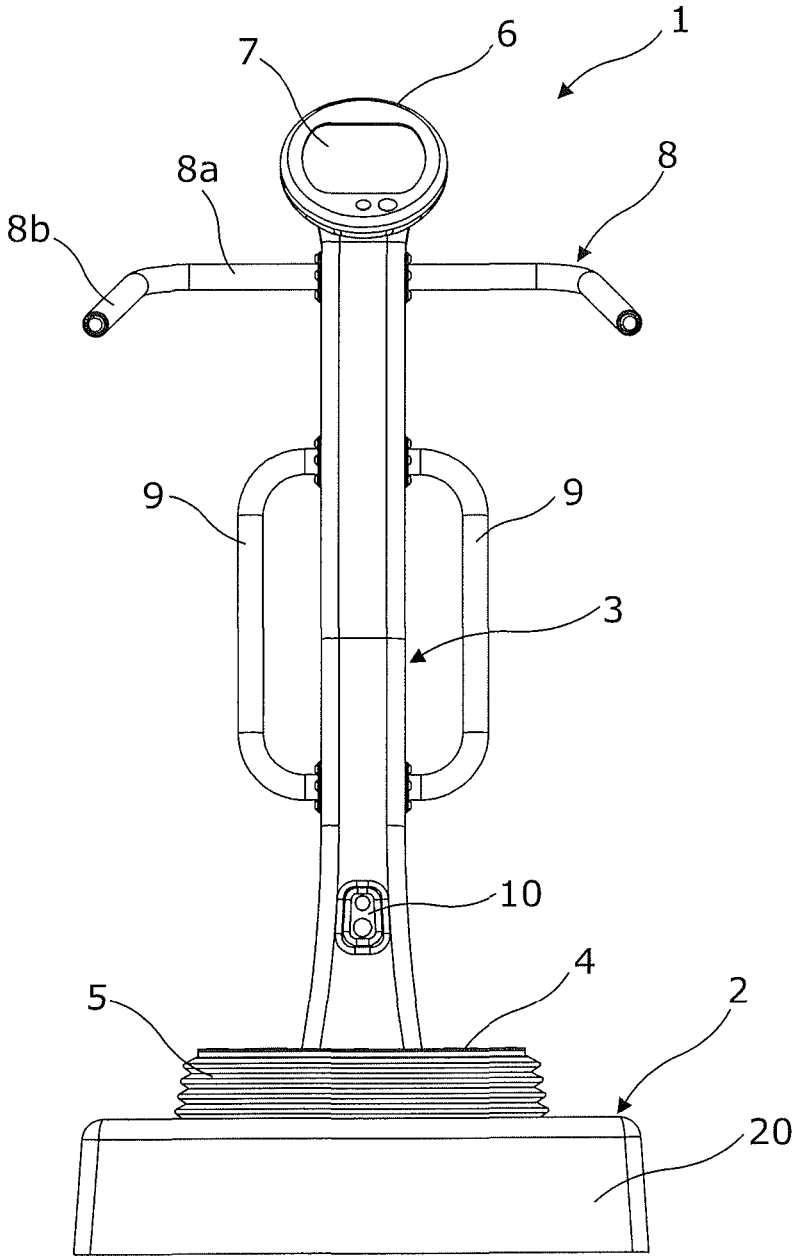
FIG. 1 shows a front view of an exercise machine in accordance with an embodiment of the invention.
Figure 4:
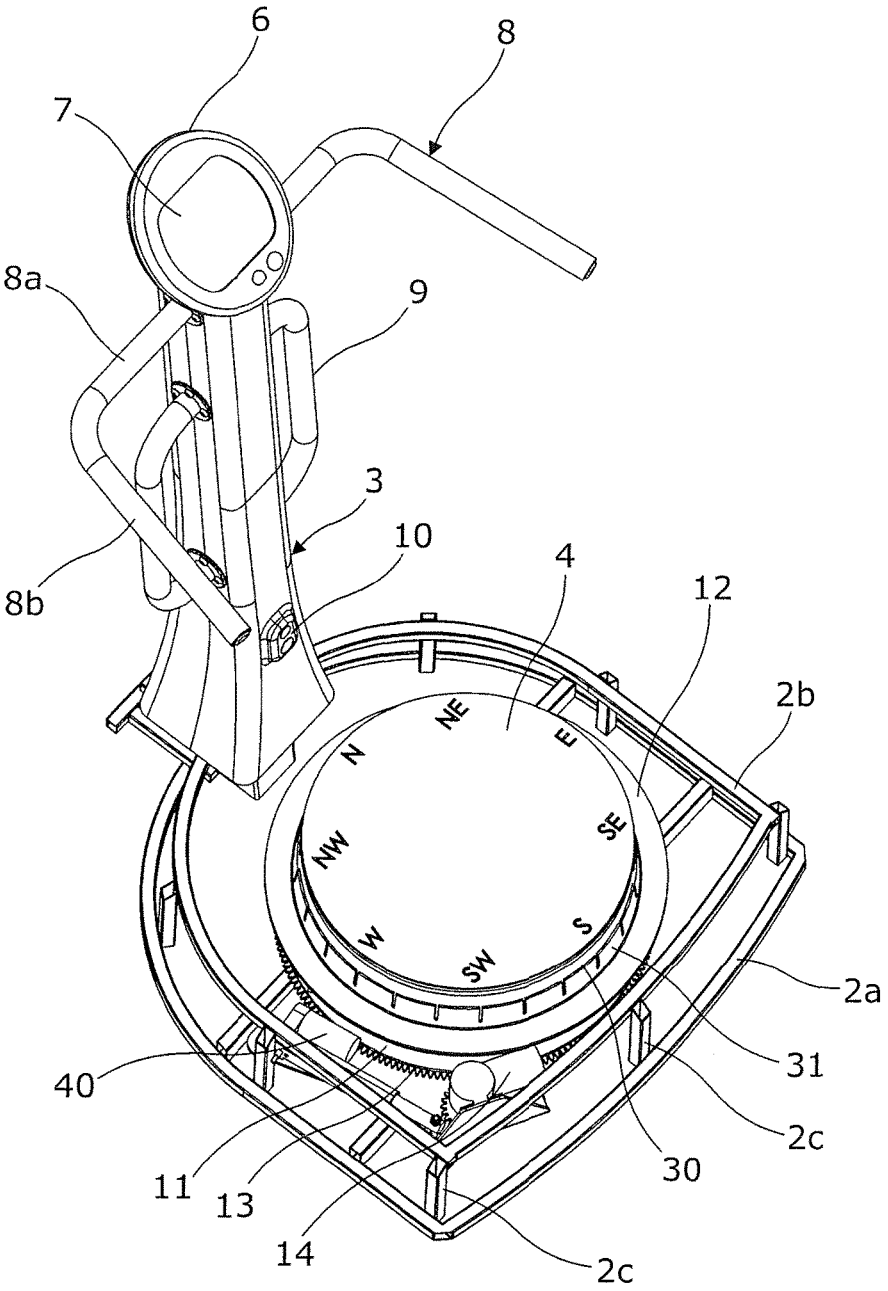
FIG. 4 shows a view from above of the base of the exercise machine shown in FIG. 1, showing in particular the mechanism for rotating the platform.
Figure 4A:
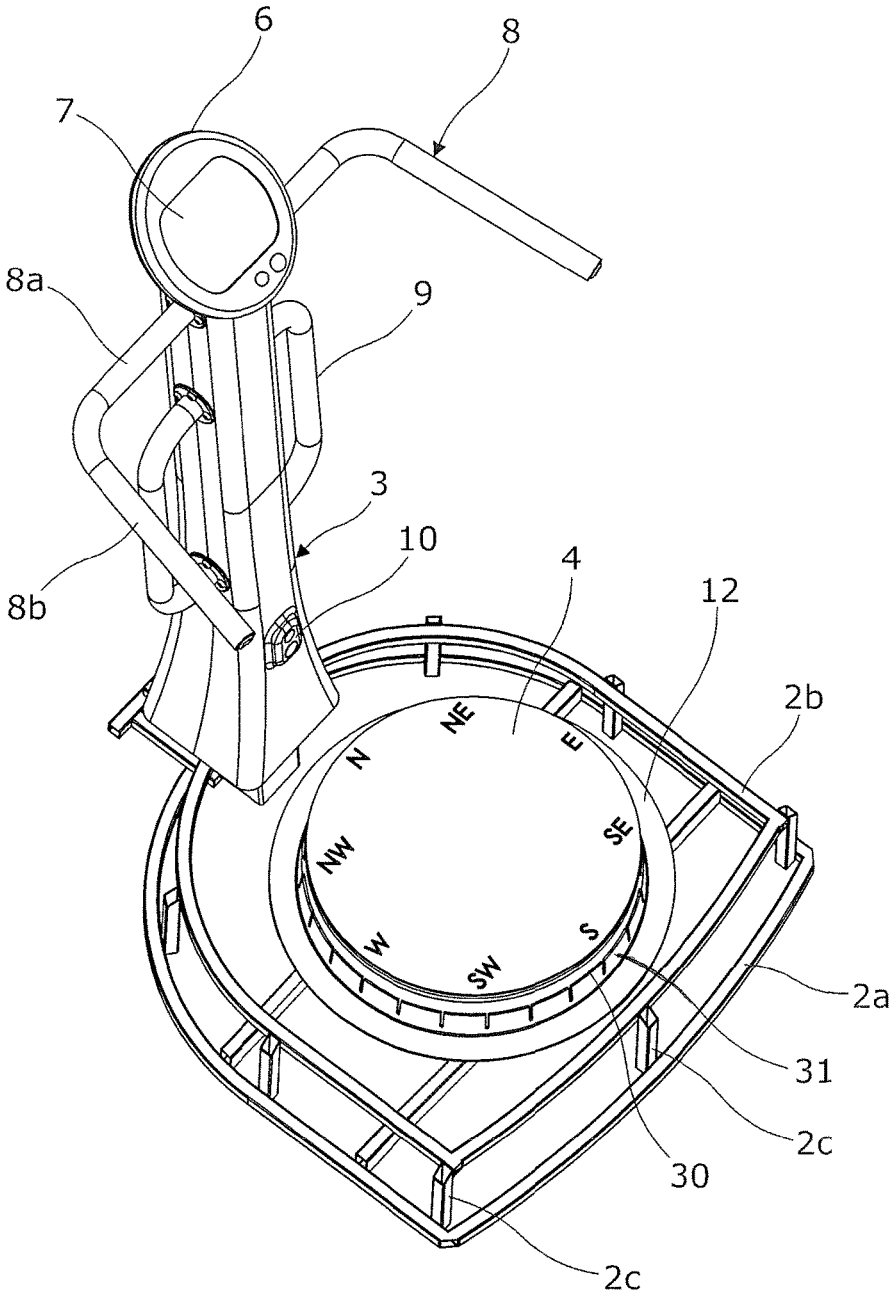
Figure 5:
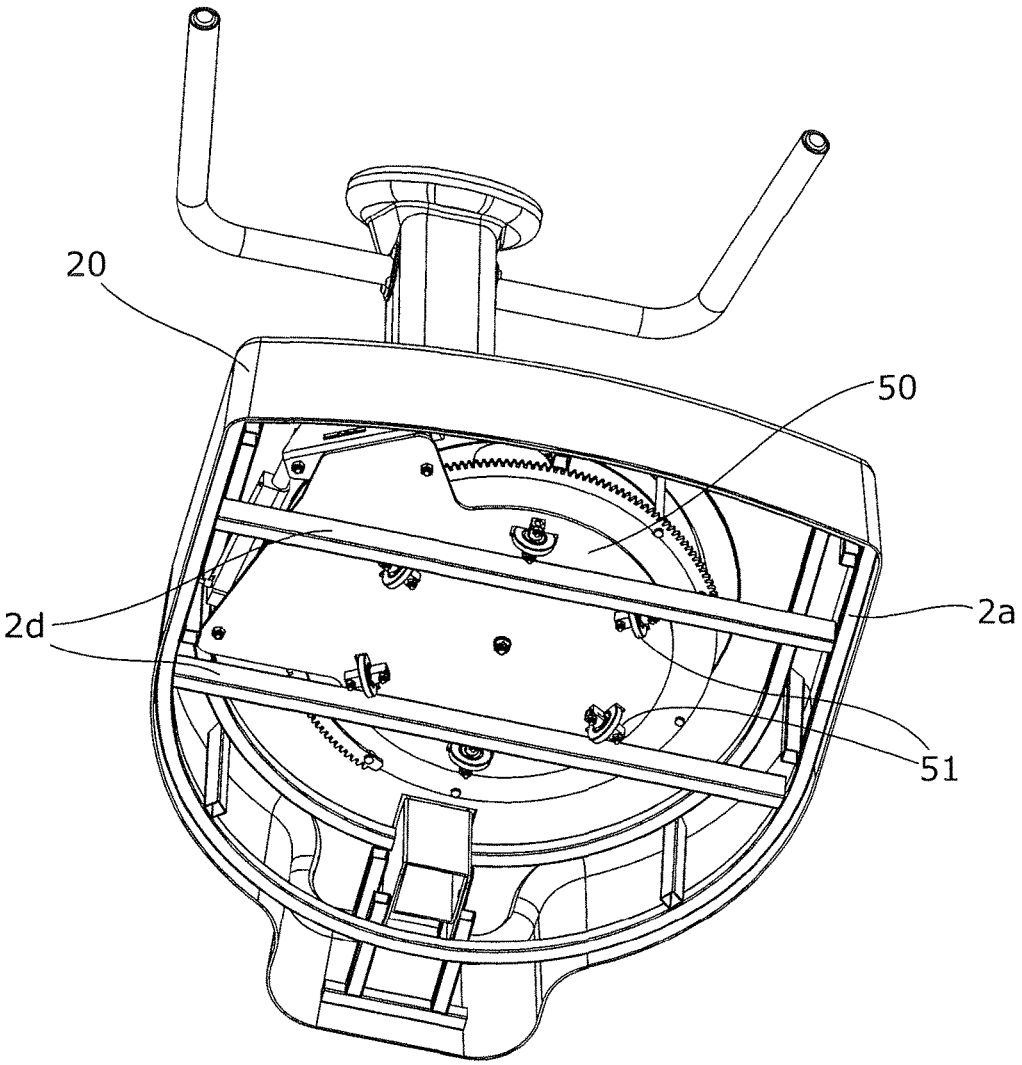
Figure 6:
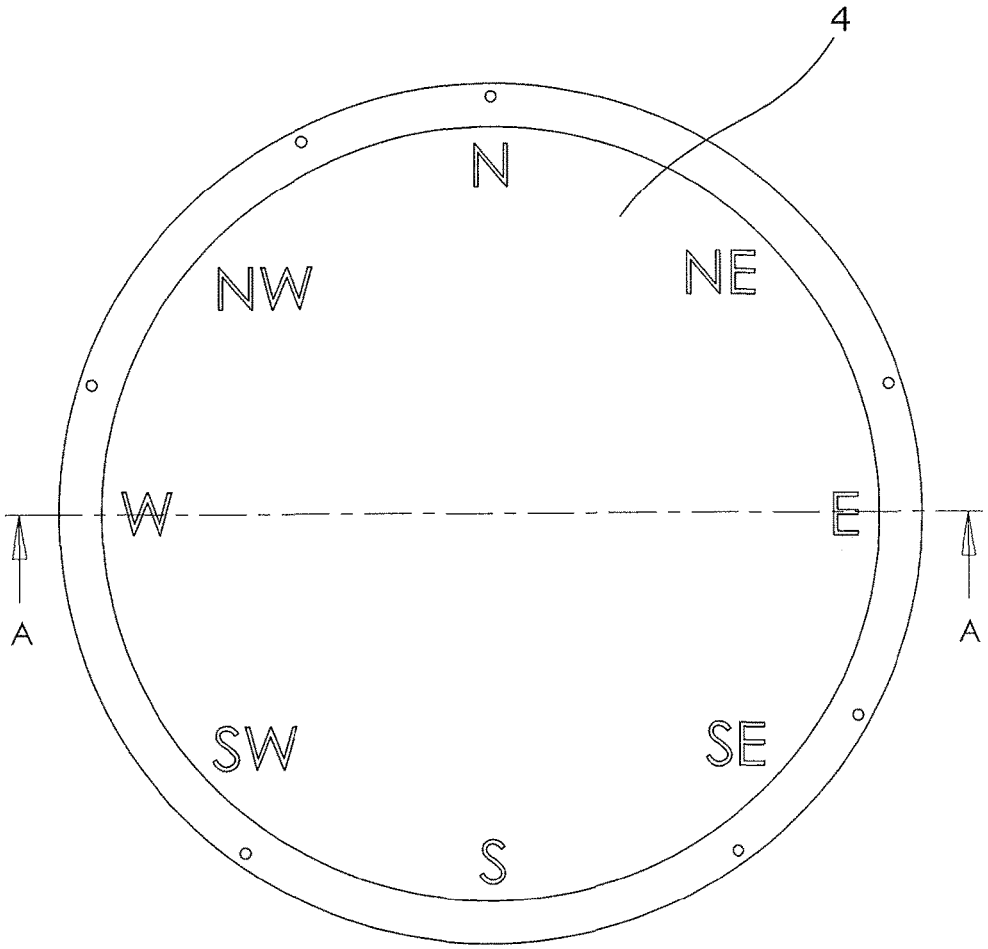
Figure 7:
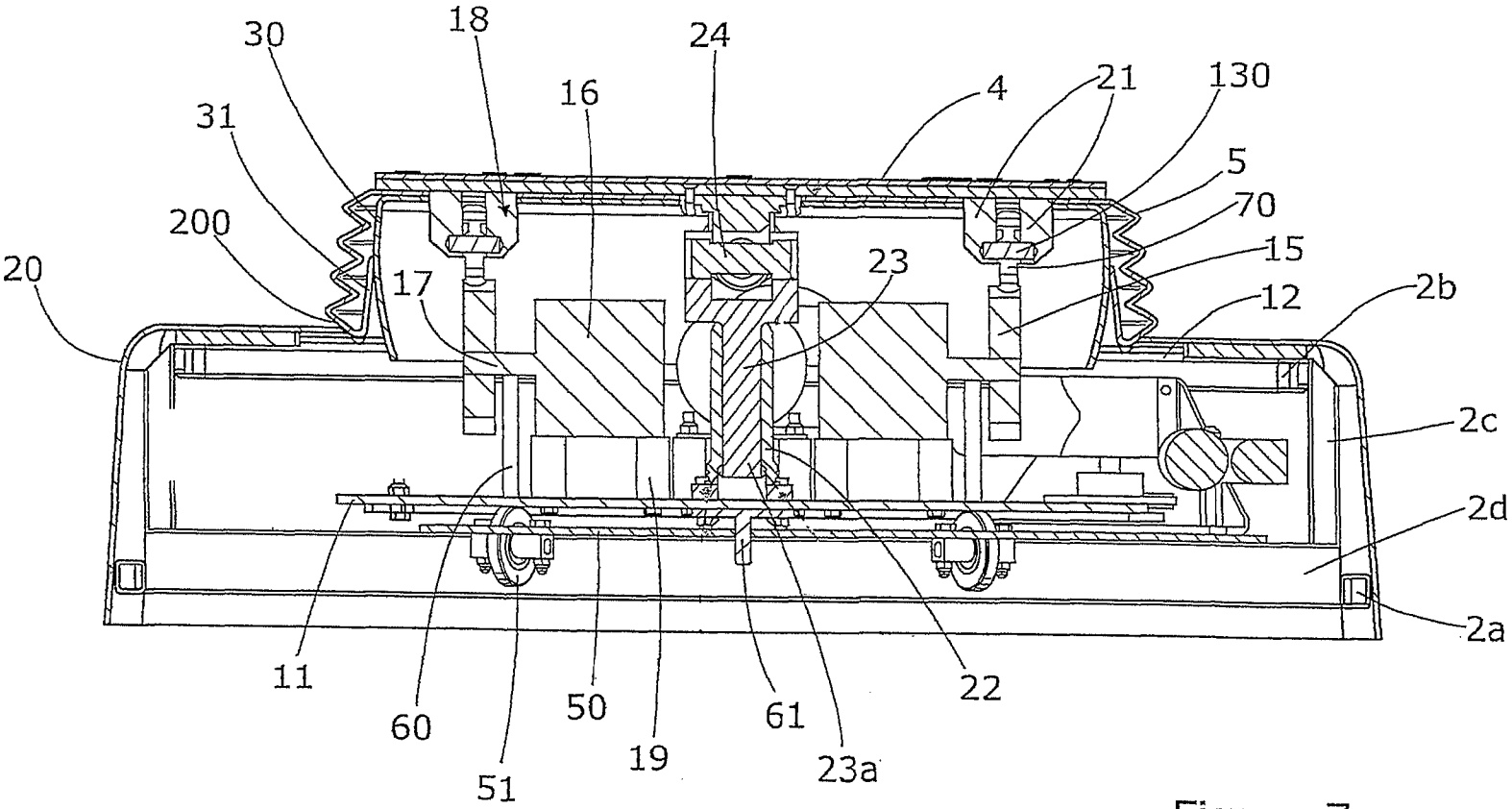
Figure 7A:
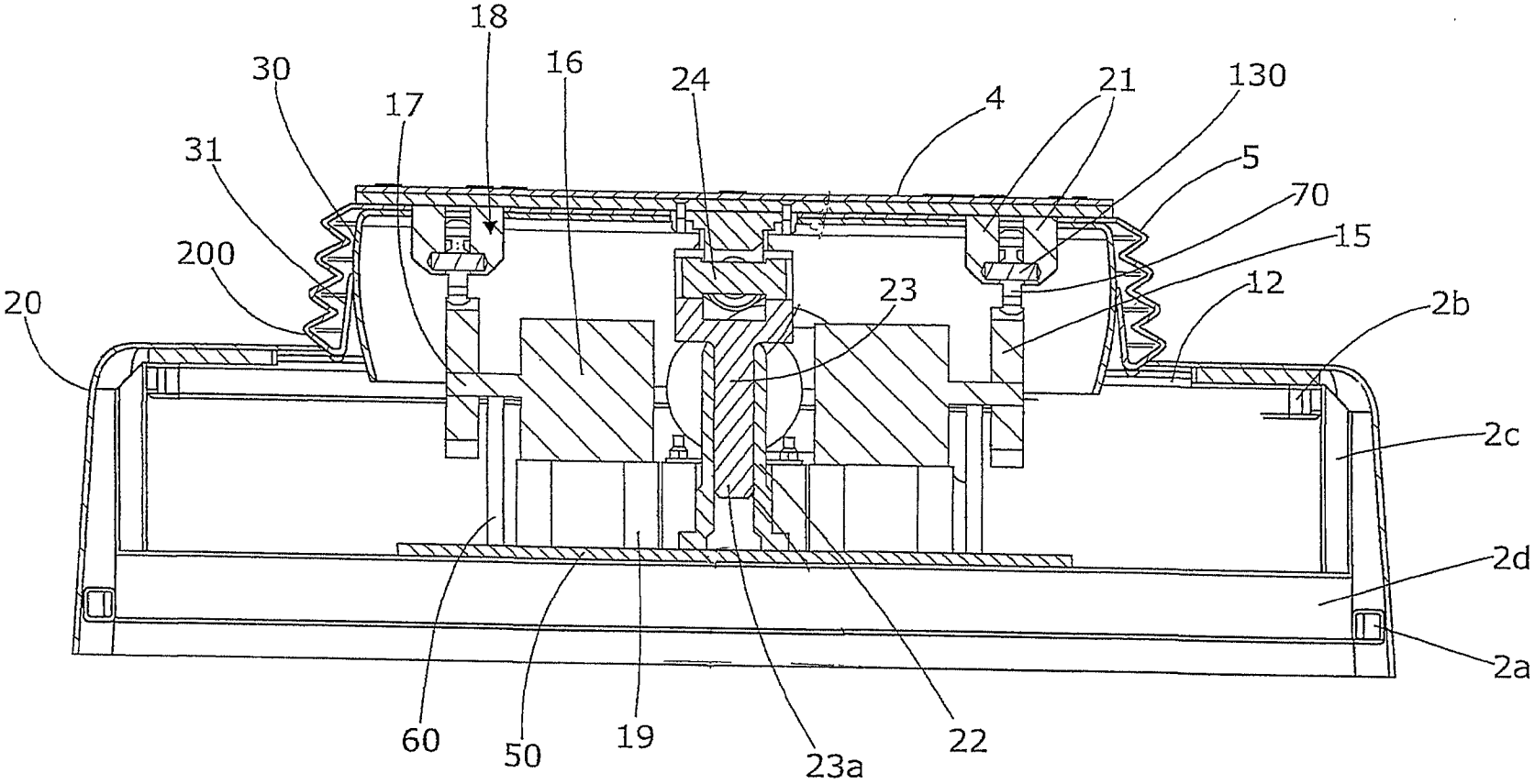
Figure 8:
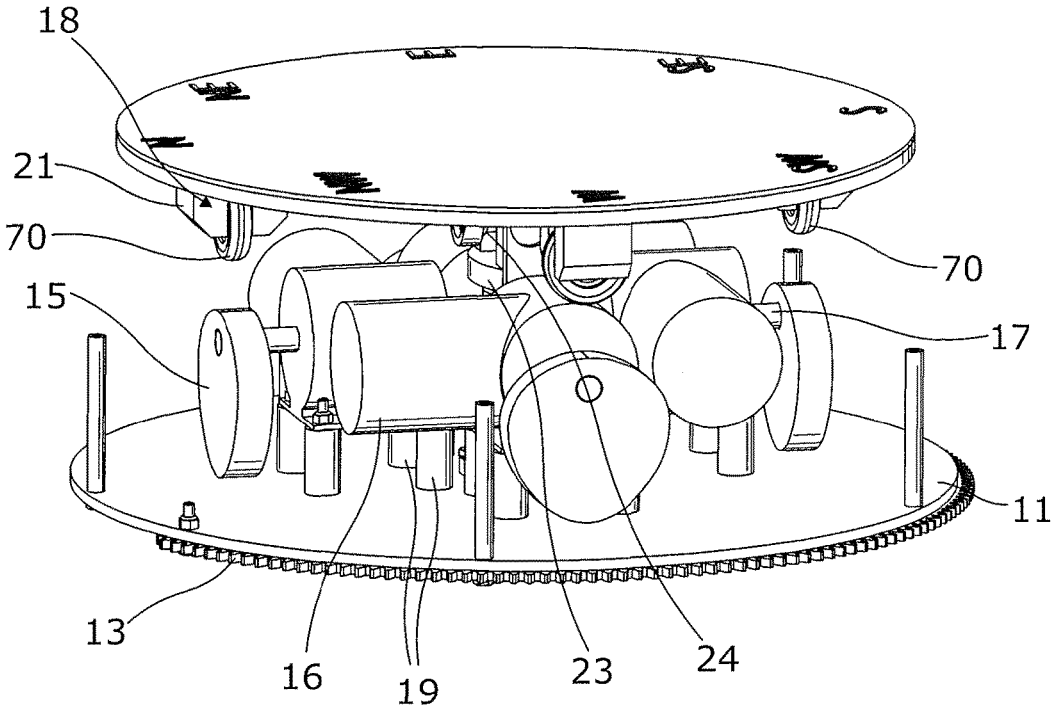
Figure 9:
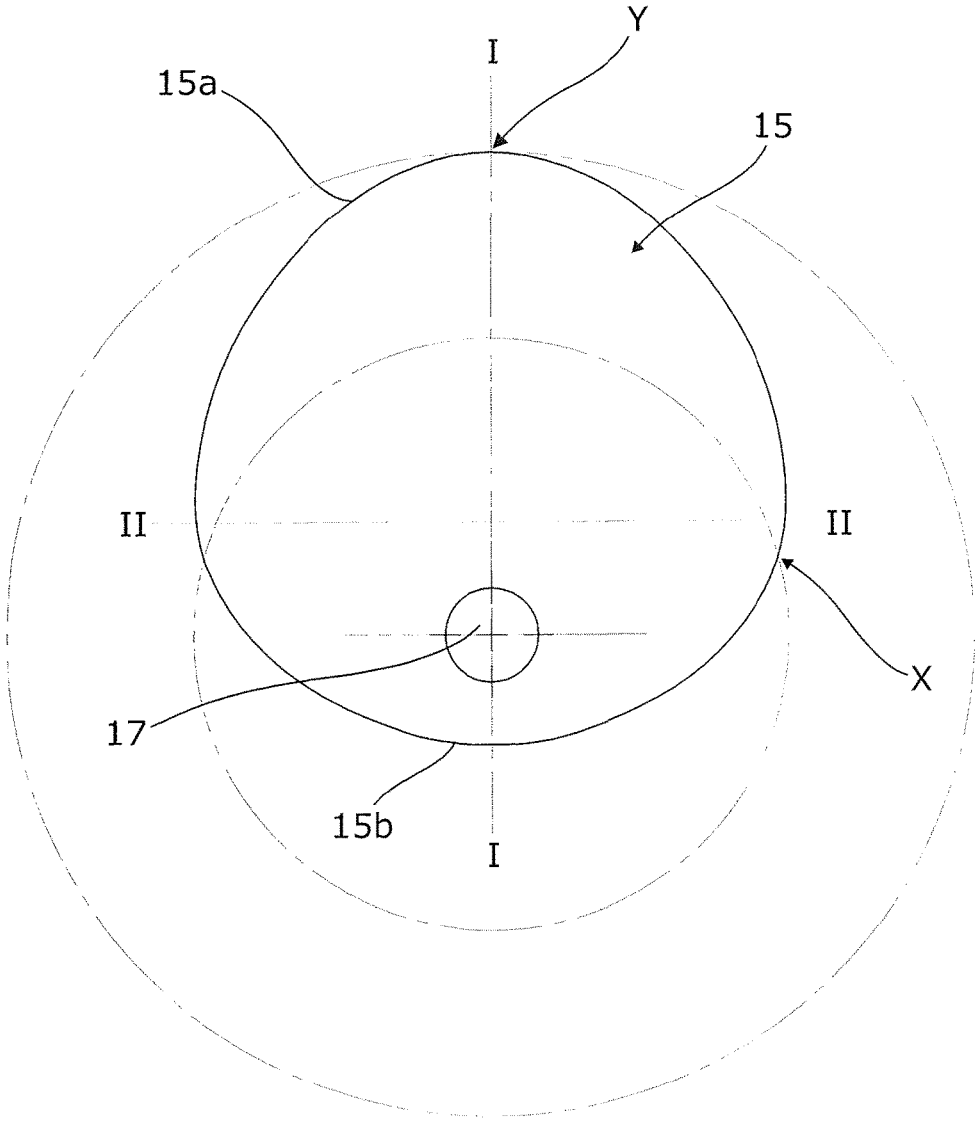

FIG. 4*a* shows a view from above of a further embodiment of the base of the exercise machine shown in FIG. 1;

FIG. 5 shows a perspective view from below of the exercise machine of FIG. 1;

FIG. 6 shows a plan view of the platform 4 of the machine of FIG. 1;

FIG. 7 shows a cross section through the base of the machine of FIG. 1 (along line A-A of FIG. 6);

FIG. 7*a* shows a cross section through the base of the machine of FIG. 1 according to a further embodiment (along line A-A of FIG. 6);

FIG. 8 shows detail of the platform arrangement from the base shown in FIG. 1;

FIG. 9 shows a first cam design; and

FIGS. 10 to 14 show various example positions of the platform 4 of the exercise machine of FIG. 1.

Figure 2:
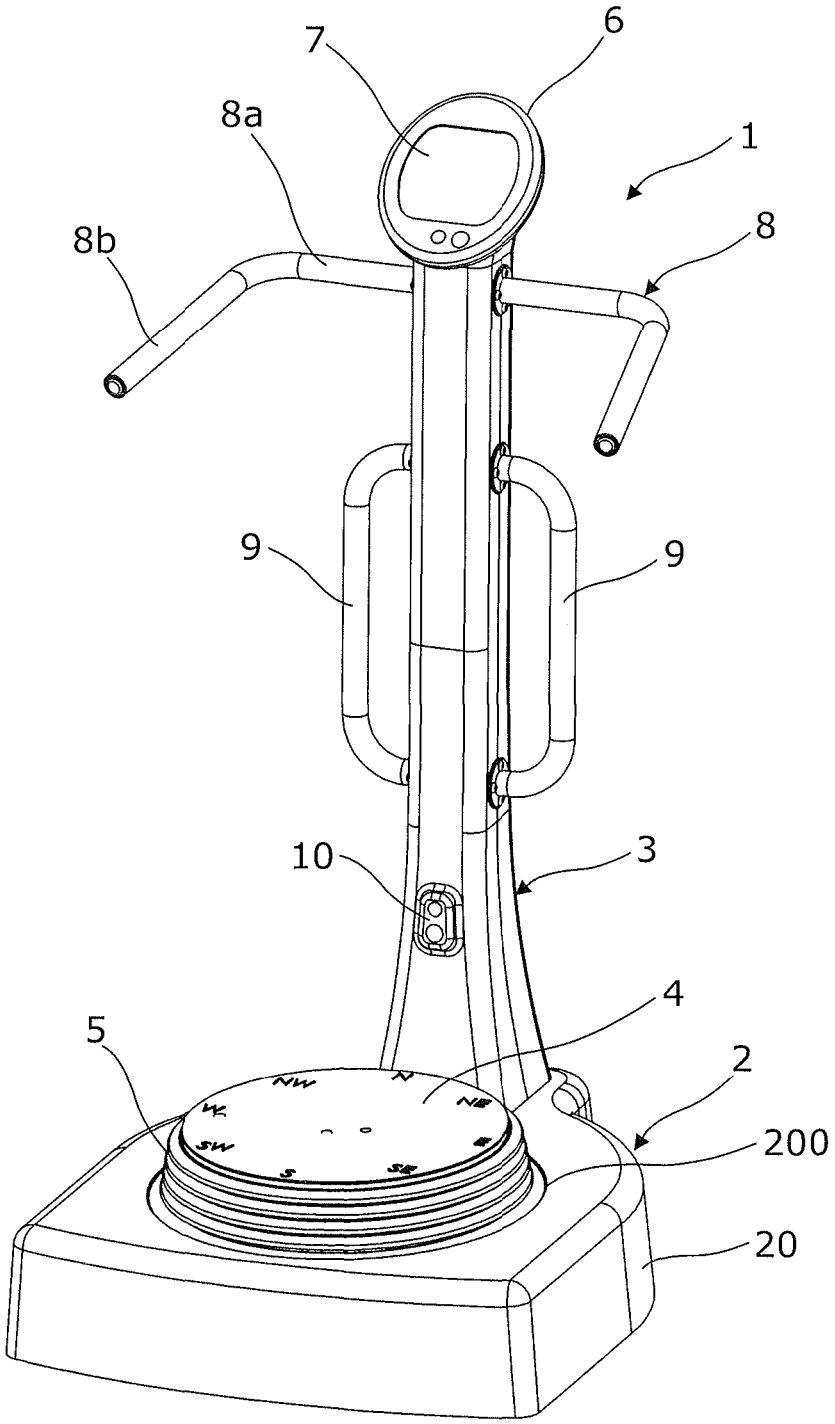
FIG. 2 shows a perspective view of the exercise machine of FIG. 1.
Figure 3:
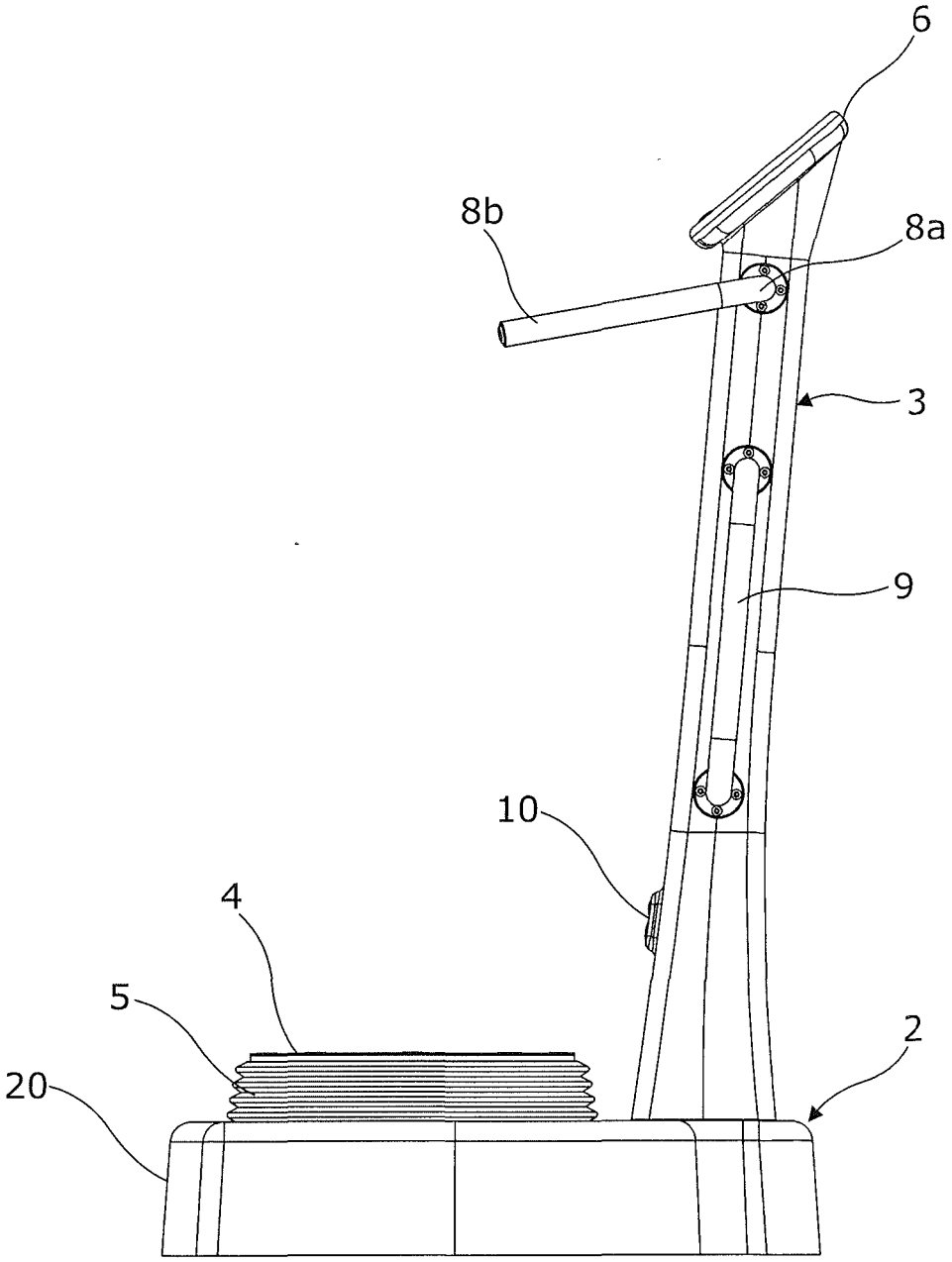
FIG. 3 shows a side view of the exercise machine of FIG. 1.

FIGS. 1 to 3 show various views of an exercise machine 1 in accordance with an embodiment of the invention. The machine 1 has a base 2 which, when viewed in plan from above is generally "D" shaped and when viewed from the side has a uniform depth. The base is provided with a cover 20, of a shape and size corresponding to the base, which has an upper surface and side walls extending down from the upper surface to completely cover the base and meet the surface that the base 2 is resting on.

An upright column 3 is mounted in the base 2 extending upwards from the centre of the curved part of the "D" shaped base when said base is viewed in plan.

Also provided and positioned above a top surface of the cover 20 of the base is a circular platform 4, which platform can rotate and tilt as will be described in more detail below.

The cover 20 of the base 2 is provided with a circular cut out 200 of larger diameter than the platform 4 arranged concentrically relative to the platform 4. A frustoconical protective guard 5 extends from the perimeter of the cut out 200 to the perimeter of the platform 4 and helps to prevent accidental access to the machine parts housed within the base 2, which will be described in more detail below. The guard 5 is in the form of a flexible rubber gator provided with a number of parallel ribs each extending around its circumference to allow extension and contraction with movement of the platform 4.

The upright column 3 is provided with a controller 6 and visual display 7 mounted at its upper end. The controller 6 controls movement of the platform 4 through suitable electronics/electronic circuitry.

The upright column 3 is provided with two sets of handles for use by the user during exercise. The first set of handles comprises two handles 8, each positioned at the top of the upright column, just below the visual display 7. The handles 8 each have a first portion 8*a* extending outwards approximately horizontally from opposite sides of the upright column in front of where the user would be positioned. The handles 8 each have an obtuse angled return portion 8*b* extending from the first portion. The handles 8 form, in use, a generally U shaped handle around the user when taken together.

There is provided a second set of handles positioned about halfway down the upright column 3. This second set comprises two handles 9 positioned on opposite sides of the upright column and each handle is approximately C shaped and is mounted on one side of the upright column 3.

The upright column 3 is provided with an on/off switch 10 positioned at the bottom of the upright column in addition to any on/off switch provided as part of the controller.

FIGS. 4 and 4*a* show the base 2 of the machine of FIG. 1 with the cover 20 and the guard 5 removed and the interior of the base 2 open to view. The base 2 comprises a frame to give the shape and strength. The frame is made up of two frames parts 2*a*, 2*b* of approximately the same size and shape, generally "D" shaped, positioned parallel but spaced apart from each other by a number of uprights 2*c*. The frame parts and uprights may be provided as a welded assembly. The platform 4 is visible and in FIG. 4 a motor plate 11 is provided within the base and spaced apart from the platform 4.

The motor plate 11 is generally circular and has a diameter larger than that of the platform 4. The motor plate 11 is provided with gear teeth 13 extending around at least part of its perimeter. A motor 14 is provided positioned in one of the corners of the base 2 situated furthest from the upright column 3. The motor 14 is mounted such that it can move to engage the gear teeth 13 of the motor plate and when activated cause rotation of the motor plate and the parts secured thereto, including the platform 4 which is not independently rotatable. The motor is brought into contact with the teeth and moved away again by use of actuator 40.

In FIG. 4*a* there is no motor plate provided nor is there a motor, the platform 4 is secured directly to a part of the base (not shown in this figure).

FIG. 5 shows the underside of the base 2, with the cover 20 in place over the frame of the base 2. Cross braces 2*d* are provided extending across the width of the base frame part 2*a*. Within the base 2 and mounted on the cross braces 2*d* is a base plate 50 provided with wheels 51 positioned such that they extend through the base plate 50 and contact the under side of the motor plate 11. The base plate 50 has the motor plate 11 and the motor 14 mounted on the upper side thereof, which faces into the base 2. The motor plate 11 can rotate relative to the base plate 50 and is supported on the wheels 51.

In some embodiments there need not be a motor plate and the base plate may support the platform or it may be supported by another part of the base, as shown in FIG. 7*a*.

FIG. 6 shows a plan view of the platform 4, the compass points have been added simply as points of reference to assist in describing some of the movements that the platform is capable of by means of FIGS. 10 to 14. The N point is positioned closest to the column 3 in use.

FIGS. 7 and 7*a* show the base 2 in cross section along line A-A of FIG. 6. Visible are frame parts 2*a* and 2*b*, uprights 2*c* and cross braces 2*d*. In FIG. 7 the motor plate 11 is shown positioned within the base 2 mounted on the base plate 50 through pivot point 61 such that it can rotate about its centre point. Positioned above the frame part 2*b* is the platform 4.

Positioned between the platform 4 and motor plate 11 is a guard support ring 12. The guard support ring 12 has an outer diameter that is slightly larger than that of the motor plate 11. The guard support ring 12 is mounted on the motor plate 11 by means of a number of uprights 60 extending between the plate and the ring. The centres of the platform 4, the motor plate 11 and the guard support ring 12 lie on the same longitudinal axis passing through the centres of the platform 4, motor plate 11 and guard support ring 12 when they are all positioned spaced apart and parallel to each other.

Cover 20 is provided on the base with cut out 200 positioned just above the support ring 12 and having a diameter between the inner and outer diameters of the guard support ring 12.

In use the motor plate 11 and guard support ring 12 lie horizontal to the surface on which the machine stands and the longitudinal axis through the centres of the platform 4, motor plate 11 and guard support ring 12 is vertical.

The centre of the platform 4 is secured to the centre of the motor plate 11 by means of a tubular housing 22 extending from and secured to the centre of the motor plate 11. There is provided a corresponding telescopically sliding spline shaft 23 secured to the centre of the underside of the platform 4 by a universal joint 24. The spline shaft 23 is received by the housing 22. The spline shaft is not rotatable within the housing.

The section further shows four motors 16 secured to the motor plate 11 by mounts 19. Each motor has a cam 15 secured to it via a shaft 17.

The underside of the platform is also provided with four cam followers 18 each comprising two housing blocks 21 with an axle 130 extending between them holding a free rotating wheel 70, having a rubber tyre, acted upon by the cam.

The cam followers 18 are spaced equidistant from each other close to the circumference of the underside of the platform 4.

The guard 5 extends from and is secured to the underside of the platform 4 and extends to and is secured to the guard support ring 12. The cover 20 may abut or pass over a part of the guard support ring 12 and the part of the guard 5 secured thereto.

The guard 5 is made of a rubber material and is free to flex with movement of the platform 4 by means of the material and a number parallel ribs extending around its circumference, the guard 5 is effectively a gator.

Secured to the underside of the platform 4, extending around its perimeter and away from the underside of the platform and past the position of the guard support ring 12 is a casing 30 having a shape similar to that provided by the side wall of a barrel. The casing is positioned within the guard 5. The distance from the centre point of the universal joint 24 to any part of the casing 30 is the same.

Extending upwardly from the support ring 12, inside the guard 5, but outside the casing 30, is a ring of upwardly extending fingers 31 (also shown in FIG. 4) formed from a resilient material and shaped, sized and biased to contact the outer surface of the casing 30 whatever its position.

The casing 30 and the fingers 31, together with the guard 5, prevent any accidental access to the area of the machine beneath the platform 4 and within the base 1 which could be damaged or lead to accidents or injury. Not all of these three parts are required but it is preferred that they are all present.

The guard 5, casing 30 and finger 31 are all secured to one or both of the platform 4 and guard support ring 12. The platform 4 and guard support ring 12 are secured to the motor plate 11 such that rotation of the motor plate 11 causes rotation of the guard support ring 12, the platform 4 and all parts secured thereto.

FIG. 7*a* shows an embodiment in which there is no motor plate 11 and therefore the guard support ring 12 extends between the platform 4 and the base plate 50. In this embodiment the centre of the platform 4 is secured to the base plate by the spline shaft 23 and the housing 22. The motors 16 are secured to the base plate 50.

FIG. 8 shows in more detail the platform 4, motor plate 11 and the cam and motor arrangement therebetween.

It can be seen that the motor plate 11 has mounted on it, by suitable mounting blocks 19, the four motors 16. The cam followers 18 can be seen to be made up of freely rotating wheels 70 each mounted on an axle (not shown in this figure) extending between two parallel and spaced apart housing blocks 21. The wheels 70 are covered with a rubber "tyre" to cushion and smooth their contact with the cams, therefore acting as shock absorbers. The tyres also assist in compensating for any angular errors caused by movement of the cams and platform.

FIG. 9 shows a first design of cam 15. The cam is generally egg shaped and therefore has a longitudinal axis I-I extending between a narrow curved end 15*a* and a broad curved end 15*b* forming an axis of symmetry. The cam also has a second axis II-II, which is not an axis of symmetry, positioned transverse to the longitudinal axis I-I and positioned co-extensive with the line of greatest width of the egg shaped cam.

The shaft 17 is secured to the cam 15 at a position along the longitudinal axis I-I that is mid way between axis II-II and the point where the longitudinal axis I-I intersects the broad end 15*b*.

During rotation the cam has a point of no active engagement where the point where the longitudinal axis I-I intersects the broad end 15*b* is positioned closest to the cam follower. The cam also has a first point of active engagement X with the cam follower which is after travel through about 100°, starting from the point where the longitudinal axis I-I intersects the broad end 15*b* and gives at least contact with the associated cam follower and may also give a first level of lift to the associated area of the platform 4. The cam has a second point of engagement Y after travel through 180° starting from the point where the longitudinal axis I-I intersects the broad end 15*b* (therefore at the point where the longitudinal axis I-I intersects the narrow end 15*a* of the cam) which gives a second level of lift to the associated area of the platform, which second level of lift is greater than the first level of lift relative to the motor plate 11.

The same arrangement would be used if the motor plate were not present and the motors, cams and platform were mounted directly on the base plate 50.

FIGS. 10 to 14 show various example positions that can be adopted by the platform 4 and discuss the movements the platform can make that can be driven by the machine or the user.

Figure 10:
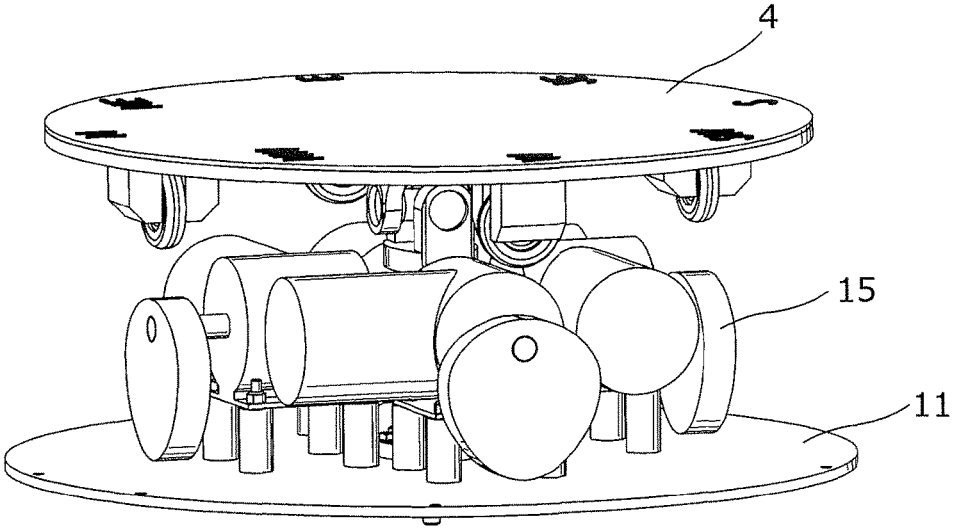

FIG. 10 shows a first position of the platform 4 in which none of the cams are actively engaged with the cam followers and therefore the platform 4 is totally free to move about the universal joint 24. Accordingly in this position the platform can be used as a wobble board and the user can perform exercises whilst trying to keep the platform stable.

Figure 11:
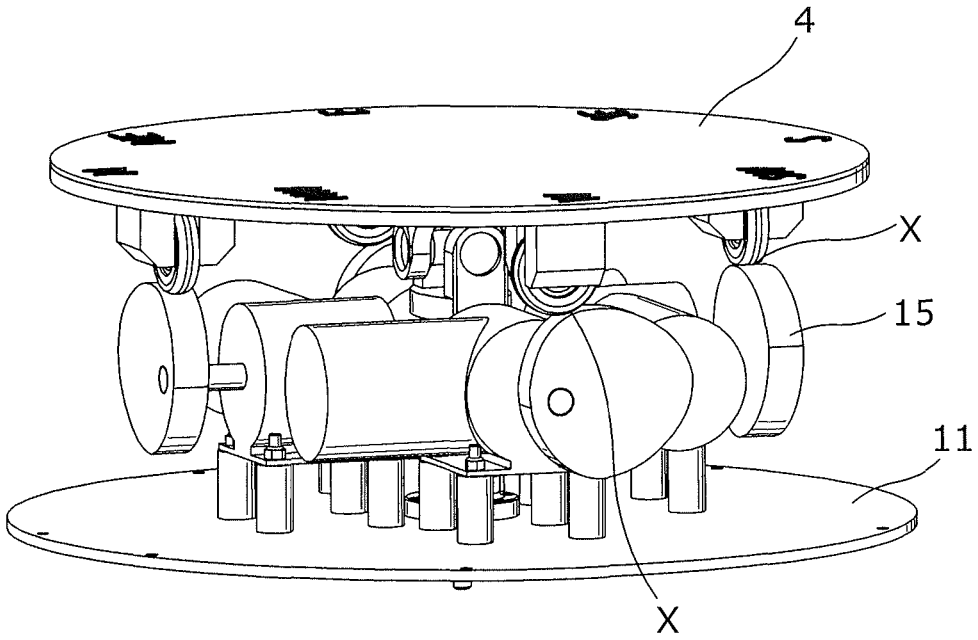

FIG. 11 shows a second position of the platform 4 in which the cams are all actively engaged with the cam followers through the first point of engagement X discussed above in relation to FIG. 9. In this position the platform is locked in position and is parallel to motor plate 11 and generally also to the surface the machine 1 is standing on. This position may well be the position that the platform 4 is put into for a user to safely mount and dismount. In this position the platform can rotate about its centre point. Rotation can be caused by the user if the motor 14 is disengaged from the gear teeth 13 of motor plate 11 or rotation can be caused by the machine through action of the motor 14 on the gear teeth 13 provided on the perimeter of the support plate 11.

Figure 12:
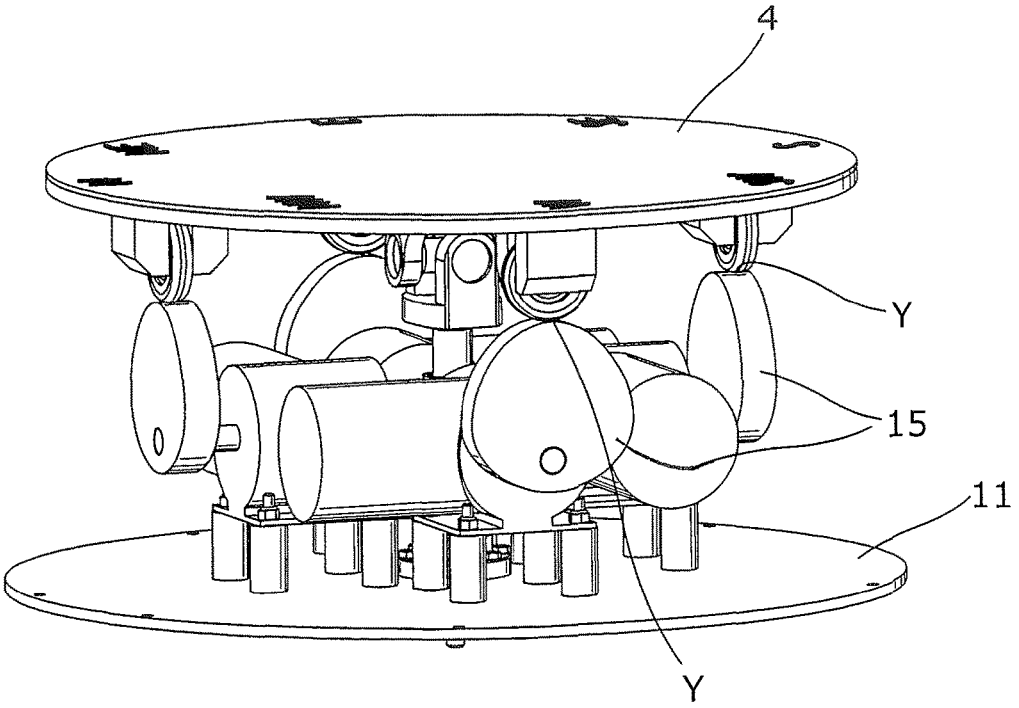

FIG. 12 shows a third position of the platform 4, which is similar to that of FIG. 11 except that the cams are all engaged with the cam followers through the second point of engagement Y discussed above in relation to FIG. 9, in this position the platform is higher than in the position shown in FIG. 11. In this position the platform is locked in position and is parallel to the motor plate 11 and generally also the surface the machine is standing on. Again, this position may well be the position that the platform is put into for a user to safely mount and dismount. In this position the platform can rotate about its centre point. Rotation can be caused by the user if the motor 14 is disengaged from the gear teeth 13 of motor plate 11 or rotation can be caused by the machine through action of the motor 14 on the gear teeth 13 provided on the perimeter of the support plate 11.

Figure 13:
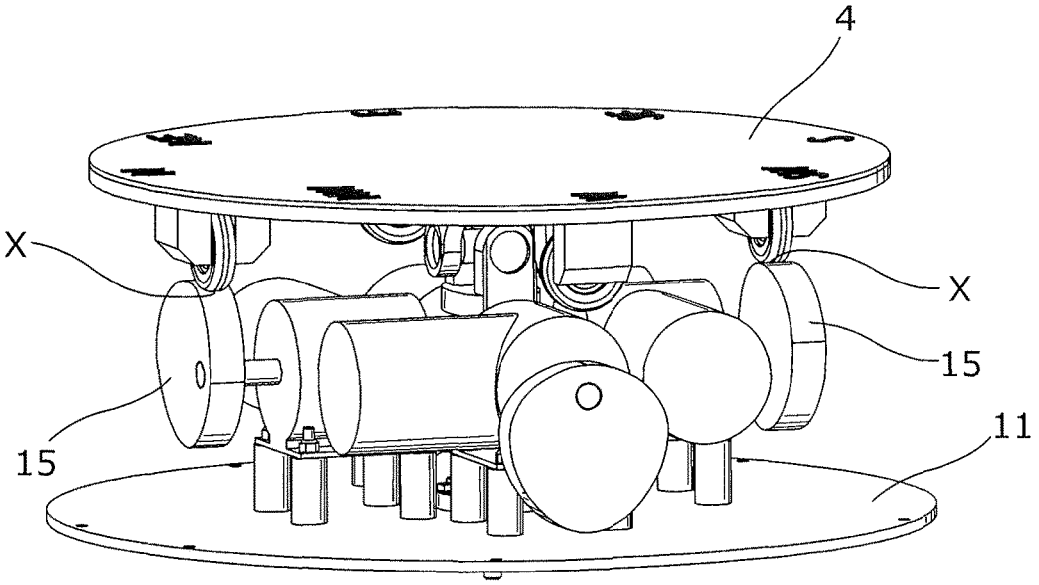

FIG. 13 shows a fourth position of the platform 4 in which two oppositely positioned cams are engaged with the corresponding cam followers through the first point of active engagement X discussed above in relation to FIG. 9. In this position the cams engaged through the first point of engagement are those in the N and S positions, i.e. those at the front and back of the platform 4 when the user is in position facing the upright column 3. The platform can, in this position, tilt about an axis running between the N and S positions of the platform, effectively acting as a further type of wobble/balance board on which the user can perform exercises whilst keeping the platform stable. In this position the platform can rotate about its centre point if desired, rotation can be caused by the user if the motor 14 is disengaged from the gear teeth 13 of motor plate 11 or rotation can be caused by the machine through action of the motor 14 on the gear teeth 13 provided on the perimeter of the support plate 11.

Figure 14:
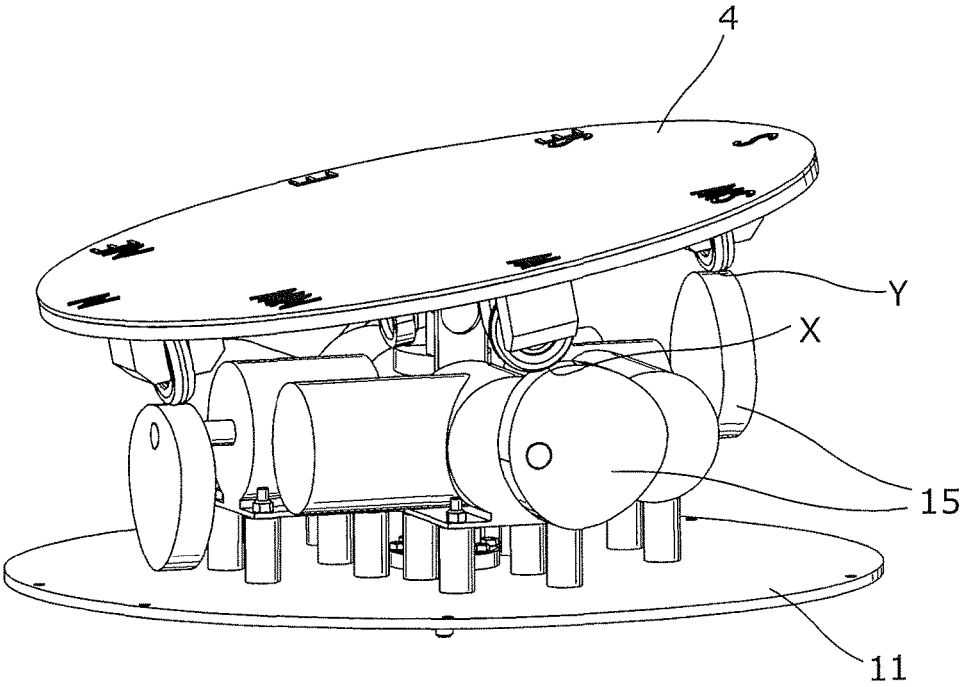

FIG. 14 shows a fourth position of the platform 4 in which two oppositely positioned cams are engaged with the corresponding cam followers through the first point of active engagement X discussed above in relation to FIG. 9. In this position the cams engaged through the first point of engagement are those in the E and W positions, i.e. at the sides of the platform 4 when the user is in position facing the upright column 3. In this position one of the cams in the N and S positions, i.e. at the front and back of the platform, in this case the cam at the S position, i.e. the back of the platform, is engaged with the corresponding cam follower through the second point of active engagement Y discussed above in relation to FIG. 9. The remaining cam has its can follower forced into contact with the cam in its rest position through the position adopted by the other cams. This position gives an angled platform, the platform angles up from front, N position, to back, S position, of the platform. In this position the platform can rotate about its centre point if desired rotation can be caused by the user if the motor 14 is disengaged from the gear teeth 13 of the motor plate 11 or rotation can be caused by the machine through action of the motor 14 on the gear teeth 13 provided on the perimeter of the support plate 11.

From the position shown in FIG. 14 each cam could rotate giving a progressive movement of associated areas of the platform with movement of the cam leading to a "wave motion". For example at one moment the highest point could be "S", then "SW" then "W" etc.

The machine can move between platform positions through action of the motors and cams during use depending on the needs/desires of the user. This is controlled through the visual display and controller.

The same orientations and movements of the platform could be achieved if the motor plate was not present and the motors, cams and platform were mounted on the base plate 50.

The invention claimed is:

1. An exercise machine comprising a base, a platform having an upper side adapted in use to support a user and an underside, a support column supporting the platform in a position spaced apart from the base wherein the platform is secured to the support column such that the platform can rotate about two perpendicular axes, and three or more platform moving devices each having an engaging surface, each platform moving device independently operable by a respective motor to move all or a part of the platform, wherein one or more of the platform moving devices independently operable to move all or part of the platform is capable in use of adopting at least two positions of the engaging surfaces relative to engagement surfaces on the underside of the platform and wherein the support column comprises two or more telescopic parts, allowing vertical movement of the platform between a bottom position and a raised position, when the platform is in the bottom position, the engaging surfaces of the platform moving devices are each independently movable between a position where the engaging surfaces are spaced below and apart from the engagement surfaces on the underside of the platform, and at least one position where the engaging surfaces engage the engagement surfaces on the underside of the platform.

2. The machine of claim 1 in which the platform moving devices are all positioned beneath the platform.

3. The machine of claim 1 in which the support column is secured at one end to a part of the base.

4. The machine of claim 1 in which the support column is secured to the platform by a universal joint or a ball and socket joint.

5. The machine of claim 1 wherein there is provided a motor plate having an upper side and an underside, positioned beneath and spaced apart from the platform so that its upper side faces the underside of the platform.

6. The machine of claim 5 wherein the motor plate is mounted to the base such that it is rotatable about its centre point.

7. The machine of claim 6 wherein the motor plate and platform are secured together such that they are not independently rotatable.

8. The machine of claim 5 wherein the motor plate is provided with a telescopically extendible sliding spline shaft and elongate housing arrangement extending from the centre point of the upper side of the motor plate, the platform is provided with a universal joint, or part thereof, secured to the centre point of the underside of the platform and the universal joint is secured to a part of the telescopically extendible sliding spline shaft.

9. The machine of claim 5 wherein the motor plate is provided with gear teeth extending around all or part of its perimeter edge.

10. The machine of claim 9 provided with a motor that can act on the gear teeth of the motor plate to cause rotation of the motor plate.

11. The machine of claim 10 wherein the motor is mounted such that it can be brought into contact with the gear teeth of the motor plate as required.

12. The machine of claim 1 wherein an upright column is provided extending upwardly from the base.

13. The machine of claim 5 wherein there are four platform moving devices mounted on the motor plate.

14. The machine of claim 1 wherein there are four platform moving devices mounted on a part of the base.

15. The machine of claim 1 wherein each platform moving device is a cam.

16. The machine of claim 15 wherein each cam is shaped and/or sized and/or mounted such that the cam surface has at least one position of active engagement with the engagement surfaces on the underside of the platform.

17. The machine of claim 15 wherein each cam is egg shaped.

18. The machine of claim 16 comprising three or more cams independently operable to move all or a part of the platform, wherein one or more of the cams is capable in use of adopting at least two positions relative to the engagement surfaces on the underside of the platform.

19. The exercise machine of claim 18 wherein there is provided a support column supporting the platform in a position spaced apart from the base wherein the platform is secured to the support column such that the platform can rotate about two perpendicular axes.

20. An exercise machine comprising a base, a platform having an upper side adapted in use to support a user and an underside, a support column supporting the platform in a position spaced apart from the base wherein the platform is secured to the support column such that the platform can rotate about two perpendicular axes, and three or more platform moving devices each having an engaging surface, each platform moving device independently operable by a respective motor to move all or a part of the platform, wherein one or more of the platform moving devices independently operable to move all or part of the platform is capable in use of adopting at least two positions of the engaging surfaces relative to engagement surfaces on the underside of the platform and wherein the support column comprises two or more telescopic parts, allowing vertical movement of the platform between a bottom position and a raised position, when the platform is in the bottom position, the engaging surfaces of the platform moving devices are each independently movable between a position where the engaging surfaces are spaced below and apart from the engagement surfaces on the underside of the platform, and at least one position where the engaging surfaces engage the engagement surfaces on the underside of the platform, the engaging surfaces are capable of being positioned in any of the following: a) all simultaneously spaced below and apart from the engagement surfaces on the underside of the platform, b) all simultaneously engaged with the engagement surfaces on the underside of the platform, and c) at least one engaging surface engaging at least a portion of the engagement surfaces on the underside of the platform and the remaining engaging surfaces being spaced below and apart from the engagement surfaces on the underside of the platform.

21. The exercise machine of claim 20 wherein the support column comprises a telescopically extendible sliding spline shaft and an elongate housing.

22. The exercise machine of claim 21 wherein the spline shaft is not rotatable within the housing.

23. An exercise machine comprising a base, a platform having an upper side adapted in use to support a user and an underside, a support column supporting the platform in a position spaced apart from the base wherein the platform is secured to the support column such that the platform can rotate about two perpendicular axes, and three or more platform moving devices each having an engaging surface, each platform moving device independently operable by a respective and separate actuator arrangement to move all or a part of the platform, wherein one or more of the platform moving devices independently operable to move all or part of the platform is capable in use of adopting at least two positions of the engaging surfaces relative to engagement surfaces on the underside of the platform and wherein the support column comprises two or more telescopic parts, allowing vertical movement of the platform between a bottom position and a raised position, when the platform is in the bottom position, the engaging surfaces of the platform moving devices are each independently movable between a position where the engaging surfaces are spaced below and apart from the engagement surfaces on the underside of the platform, and at least one position where the engaging surfaces engage the engagement surfaces on the underside of the platform.

* * * * *